United States Patent [19]

deRussy

[11] 4,244,335

[45] Jan. 13, 1981

[54] CONTROL OF VEHICLE ENGINE FUEL FEED BY ELECTRO-STRESS MEANS

[76] Inventor: John H. deRussy, 529 Andros La., Indian Harbour Beach, Fla. 32937

[21] Appl. No.: 961,772

[22] Filed: Nov. 17, 1978

Related U.S. Application Data

[63] Continuation of Ser. No. 761,276, Jan. 21, 1977, abandoned.

[51] Int. Cl.[2] ..... F02M 7/00

[52] U.S. Cl. ..... 123/350; 74/865; 123/340; 123/361

[58] Field of Search ..... 74/865, 866, 854; 123/102

[56] References Cited

U.S. PATENT DOCUMENTS

| | | | |
|---|---|---|---|
| 2,177,908 | 10/1939 | Muselier | 123/119 R |
| 2,476,652 | 7/1949 | Black . | |
| 2,507,562 | 5/1950 | deRussy | 192/0.084 |
| 3,212,484 | 10/1965 | Rees . | |
| 3,575,256 | 4/1971 | Jania | 123/102 |
| 3,927,528 | 12/1975 | van der Kolk | 74/865 |

*Primary Examiner*—Ronald B. Cox

*Attorney, Agent, or Firm*—Clarence A. O'Brien; Harvey B. Jacobson

[57] ABSTRACT

This invention provides for controlling vehicle fuel feed, which may be either carburetion type or fuel injection type, by electro-stress control means with the electro-stress means being oriented in the power flow drive train of the vehicle between the engine and the drive wheels. As more load and torque is placed upon the engine through the drive train the control structure of this invention will automatically increase the input of fuel to the engine in a steady accurate manner. In one embodiment of the invention a diaphragm-type capacitance transducer is utilized, while in the other embodiment a torquemeter device is used. Both embodiments include a rheostat actuated by the accelerator pedal of the vehicle, which leads from the battery of the vehicle to an electric servomotor and solenoid which when activated, connects the leads from the electro-stress means to the servomotor when the accelerator is depressed. The invention also includes a solenoid associated with the brake pedal of the vehicle which, when the brake pedal is activated, will disconnect the leads from the rheostat to the servomotor for deactivating the fuel control during braking action.

8 Claims, 12 Drawing Figures

TORQUE
METER
42

ELECTRO-
STRESS
CONTROL
AND
COUPLING
142

6
6
40
39
38
47
44
48
45
46
31
30
35
36
18
27
222
220
119
137
37'
118
25'
25
37
26
116
117
115
113
26

144
F
O
R 162
148
140
144
R
F
48
44
40

CONTROL OF VEHICLE ENGINE FUEL FEED BY ELECTRO-STRESS MEANS

This is a continuation of application Ser. No. 761,276, filed Jan. 21, 1977, now abandoned.

BACKGROUND OF THE INVENTION

1. Field of the Invention

This invention relates generally to devices for automatically controlling fuel being fed to an internal combustion engine of a motor vehicle as the need for more power occurs.

2. Description of the Prior Art

A common problem with known type devices for controlling the speed of an internal combustion engine associated with a vehicle and the like is that the sensing means used generally is not as accurate and reliable as desired.

Another common problem is that the mechanism of know type devices is unduly complicated and expensive, and does not offer the desired reliability needed for such devices.

Another problem with known type control mechanisms is that they are designed to operate either the clutch mechanism or the brake mechanism of the vehicle and are not completely responsive to and controlled by the power drive train as such.

Known prior art patents which may be pertinent to this invention are as follows:

U.S. Pat. Nos. 3,129,795—Apr. 21, 1964
U.S. Pat. Nos. 3,204,719—Sep. 7, 1965
U.S. Pat. Nos. 3,814,224—June 4, 1974
U.S. Pat. Nos. 3,822,771—July 9, 1974
U.S. Pat. Nos. 3,896,914—July 29, 1975

None of these known prior art devices offers the new and unique features of the invention disclosed herein.

SUMMARY OF THE INVENTION

An object of the present invention is to provide an automatic fuel feed for a motor vehicle whereby fuel is automatically fed to the engine of the vehicle in accordance with its needs.

A further object of this invention is to provide an improved fuel feed for a motor vehicle wherein actuation of the accelerator of said vehicle causes electrical means to automatically feed fuel to the engine in accordane with the needs thereof.

A further object is to provide an improved automatic fuel feed whereby the fuel feed is increased automatically as the power drive requirements increase.

Another further object is to provide a novel fuel feed whereby as the need for power is increased an increase of fuel feed is accomplished by electrical means under the control of electro-stress means which are responsive to the power drive train structure.

An additional further object is to provide a fuel feed wherein the increase of torque pressure on the drive shaft is effected to actuate electrical devices for automatically feeding fuel to the engine in accordance with the power required thereby. Also associated with this structure is an automatic deactivation switch associated with the brake pedal for deenergizing the aforesaid fuel feed control mechanism when the vehicle is being braked.

A still further object of this invention is to provide a combined hydraulic drive and automatic fuel feed for a motor vehicle in combination with electro-stress devices responsive to variation in torque in the power drive train whereby fuel is automatically fed to the engine of the vehicle as the need for power therefrom changes.

Another further object of this invention is to provide a combined hydraulic drive and fuel feed for a vehicle internal combustion engine wherein the hydraulic drive includes blades and the increase of hydraulic pressure on the blades is effected to actuate capacitance transducers of the diaphragm type for automatically controlling fuel feed to the engine in accordance with the power required therefrom.

The device of this invention offers a number of new and novel features. In a vehicle having an internal combustion engine with either carburetor or fuel injection fuel feed thereto electro-stress control devices are used in the power drive train for the vehicle for variably controlling the fuel feed to the internal combustion engine when the power needs of the vehicle require same. A forward and reverse control is incorporated with the structure as well as electrical servomotor means for the fuel feed. A rheostat in combination with the gas or accelerator pedal of the vehicle also adds an input in series with that provided by the electro-stress control means. A switch and solenoid connected with the brake structure and in series with the electrical connections of the accelerator and control means will deactivate the entire fuel control structure when the brake pedal is being depressed.

Both an electrical stress device of the torquemeter type as well as of the capacitance transducer type may be used for the electro-stress control portion of the invention.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
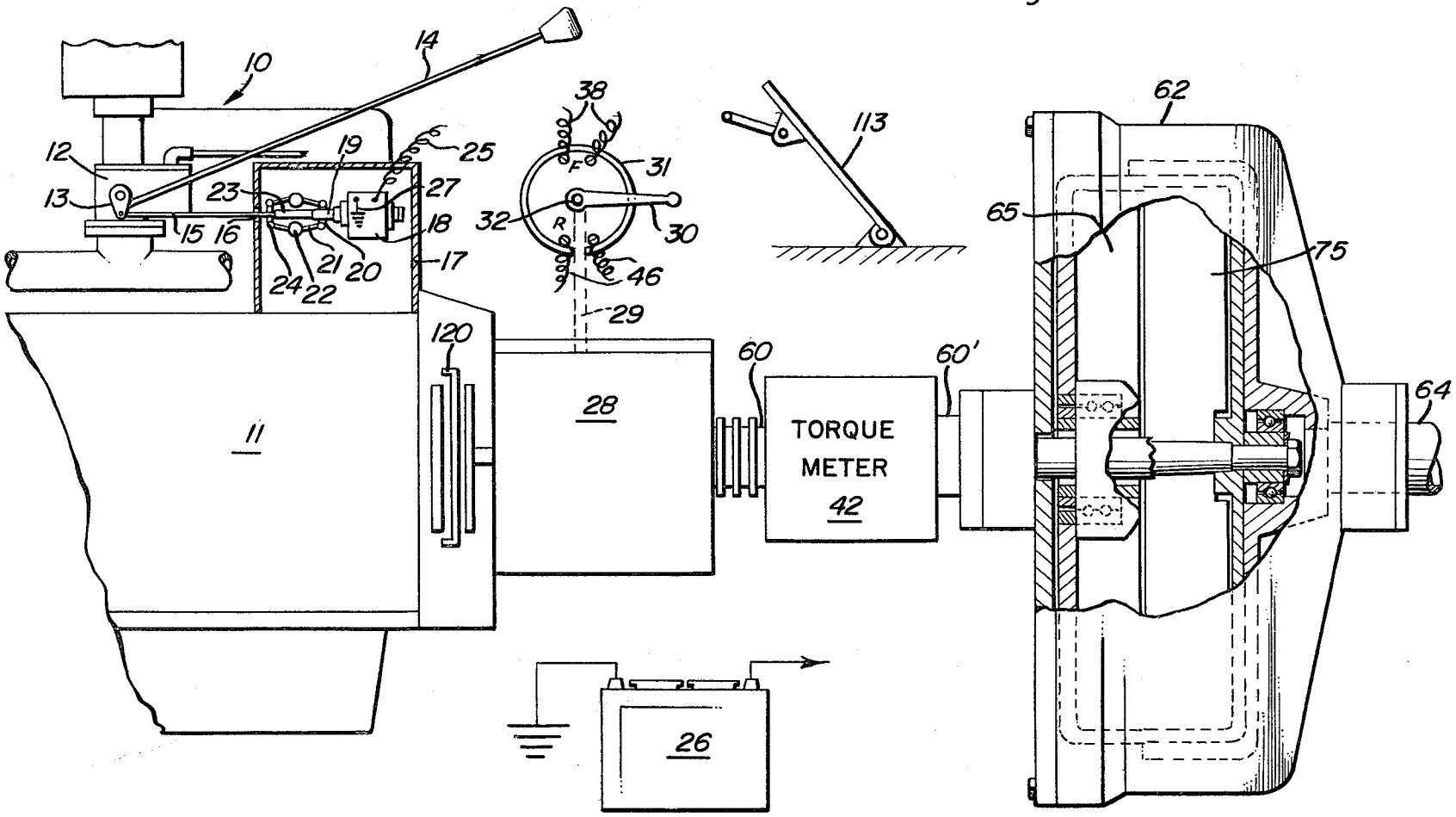
FIG. 1 is an elevational view, partly diagramatic in character, and with some parts broken away and shown in longitudinal vertical section, of the device of this invention.

Referring to FIG. 1 of the drawings, reference numeral 10 indicates in general an internal combustion engine 11 having a carburetor 12, and an actuating lever 13 for the usual butterfly fuel control valve. A manually operated rod 14 is connected to the free end of the butterfly valve lever 13 and terminates in any suitable actuating means such as a knob on the dashboard of the motor vehicle with which the device is used. A second operating rod 15 for the butterfly valve lever 13 is pivotally connected thereto and extends rearwardly and slidably through an opening 16 in any suitable housing 17 positioned adjacent the engine. A variable speed electric servomotor 18 is suitably mounted in the housing 17 and is connected by suitable leads through the electro-stress control mechanism of this invention to the battery 26 for the motor vehicle. The shaft 19 of the servomotor 18 is provided with a suitable collar 20 to which are pivotally connected for swing movement radially of the shaft a pair of governor arms 21, such governor arms carrying weights 22 at their free ends which free ends are pivotally connnected by any suitable means such as a yoke 24 to a sleeve 23 which is rotatable with the shaft 19 and slidable relative thereto and axially thereof. The free end of the sleeve 23 is pivotally connected to the free end of the auxiliary accelerator valve operating arm 15 whereby said arm is caused to reciprocate in the same manner as the sleeve 23 is reciprocated relative to the shaft 19. It thus follows that as the servomotor 18 operates at various speeds the weights 22 will be thrown radially outwardly by centrifugal force and as they do so will operate to reciprocate the sleeve 23 towards the servomotor 18 whereby to move the auxiliary operating arm 15 to the right and open the butterfly valve varying degrees commensurate with the speed of rotation of the motor 18. Thus, by varying the speed of the motor 13 in accordance with the load required as will be explained below, the proper amount of fuel is automatically fed to the carburetor 12 as required for the particular load involved. As already stated, fuel injection mechanism may be used instead of the carburetor 12 with butterfly valve lever 13 and in this type of fuel feed system control arm 15 would be suitably connected to the fuel injection mechanism.

The crankshaft, not shown, of the engine 11 is connected to a suitable transmission 28. Any suitable operating means, such as illustrated diagramatically by lines 29, connect the transmission 28 to an operating lever 30, pivoted as at 32, on a suitable support 31. In the position shown in FIGS. 1 and 2, the operating lever of this control structure is in a neutral position, but when it is swung to the position F, it is understood that the transmission is shifted to the forward speed position, and when it is swung to the position R, it is understood that the transmission 28 is shifted to reverse.

Figure 2:
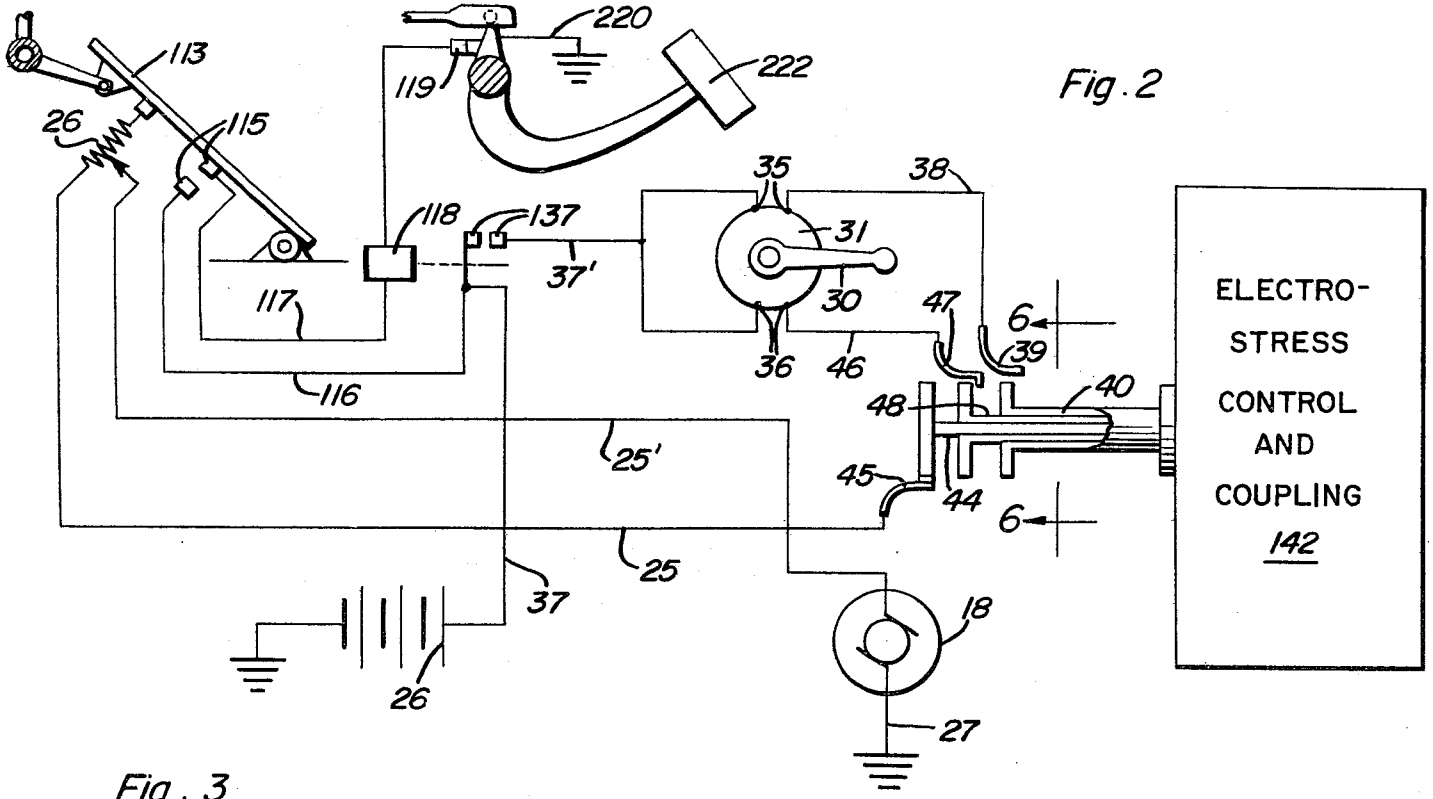
FIG. 2 is a diagramatic view showing the electrical circuits and the associated parts diagramatically.

Referring particularly to FIGS. 1, 2, 7, 8 and 9, it is apparent that the operating lever 30 also comprises a double throw switch having a contact 33 on the underside thereof which is slidable on the upper surface of the support 31. Spaced contacts 35 are provided at the forward speed position and are adapted to be bridged by the contact 33 when the lever 30 is thrown to such forward speed position. In like manner, when the lever 30 is thrown to the reverse position, the contact 33 bridges a pair of spaced contacts 36. Referring specifically to FIG. 2, it will be seen that the main lead 37 from the battery 26 provides a branch lead 38 which is normally opened by the spaced contacts 35 which is connected by a slip ring connection 39 to a further lead 40 which in turn is connected to the electro-stress device 142. This electro-stress control device 142 will be described in greater detail below, it being sufficient at this point that the device add variable resistance or impedance in the circuit path now being described. The return line from the electro-stress control device is indicated by reference numeral 44 in FIG. 2 of the drawing which in turn is connected to another slip contact 45 to a main lead 25 for the servomotor 18. The main lead 25 connects to a rheostate 26 operated by the accelerator pedal and in turn to lead 25' connected to servomotor 18, which in turn is grounded by any suitable connection 27. In like manner, the spaced contacts 36 maintain a branch lead 46 normally open but when closed connect the same to a slip ring contact 47, which in turn is connected to a lead 48 and in turn to another portion of the electro-stress control device 142. Again, the return line 44 which is responsive to the portion of the control device to which lead 48 is connected, varies the signal through contact 45 and leads 25, 25' with adjustable rheostat 26 for controlling the servomotor 18. Thus, with the operating lever 30 in the neutral position shown in FIG. 2, it is obvious that both branch leads 38 and 46 as connected to the battery 26 through lines 37, 37' and the relay switch contacts 137 are open so no electric current can flow to the servomotor 18. However, it is equally obvious that swinging the lever 30 to either the forward or reverse position will close the circuit to the servomotor 18 through the appropriate slip rings and appropriate portion of the electro-stress control device and thus the speed of the servomotor 18 will be varied in accordance with the position or variation of the elector-stress control device, assuming of course that contacts 137 (described below) are closed.

A driving shaft 60 extends rearwardly from the transmission 28 and is provided with an axial bore 61 through which extend the leads 40, 44, and 48 previously described. These leads in turn connect to the appropriate portions of the electro-stress device 142. The drive shaft continues 60' into a sealed hydraulic housing 62 of any suitable hydraulic drive unit. Internally of the hydraulic housing 62 are hydraulic drive blades 65 and driven blades 75 mounted in conventional fashion for providing a hydraulic drive coupling between the drive shaft 60' and the output shaft 64 which is normally connected to a common type universal and power wheel system.

Figure 3:
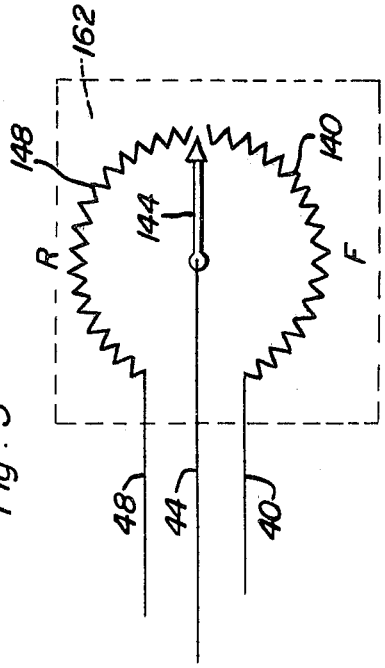
FIG. 3 is a schematic of the torquemeter rheostat.

In the primary embodiment of this invention, the electro-stress control device 142 is between the drive shaft 60 connected to the transmission 28 and the drive shaft portion 60' connected to the hydraulic coupling structure and includes a torquemeter device. This torquemeter structure is installed as an integral part of the drive shaft and may best be seen in FIG. 5. This torquemeter has a portion 160 positively secured to the drive shaft 60 and another portion 160' positively secured to the driven end 60' of the drive shaft. An arm 144 is fastened to the portion 161 of the torque rod and makes electrical contact with a double rheostat structure mounted on the face of disc member 162. This is shown schematically in FIG. 3 and diagramatically in FIG. 4 of the drawings. Suitable connections (not shown) are used to connect the rheostat to leads 40, 44 and 48. The operation is as follows: As torque is applied in either the forward or reverse direction by the back pressure from the hydraulic coupling to the torquemeter device, the arm is caused to move radially around the double rheostat on disc 162. As the torque increases, the rheostat increases the flow of electrical current through the rheostat resistance and increases the speed of the servomotor 18 to increase the flow of fuel to the engine. Similarly, when torque decreases the resistance is increased through the rheostat to decrease the electric current to the servomotor 18 and thus decrease amount of fuel being inducted or injected into the internal combustion engine.

Figure 4:
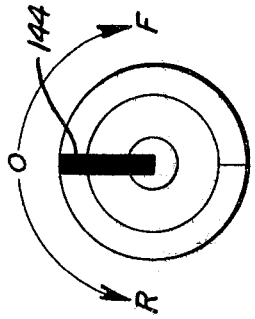
FIG. 4 is an end view of the torquemeter and rheostate electro-stress control as used with the power drive shaft.
Figure 5:
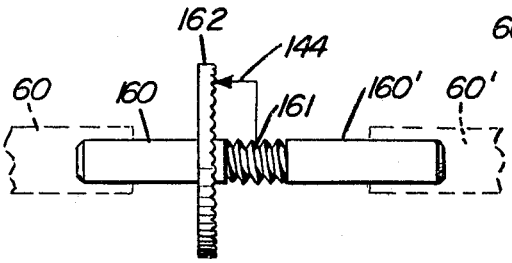
FIG. 5 is a vertical elevation taken at the torquemeter position of the drive shaft showing the torquemeter, rheostate, and the contact arm integrated with the drive shaft.

As seen in FIG. 4, the arm 144 on the torquemeter moves clockwise when the operating lever and the drive of the vehicle is in the forward position and moves counterclockwise when the operating lever and drive is in the reverse position.

Thus, in this embodiment as the pressure on the torquemeter increases the movable contact arm 144 is moved relative to the fixed resistance elements 140, 148 of the rheostat whereby to increase the flow of current to the servomotor 18, which in turn increases the speed thereof and is therefore operative to spread the governor weights 22 and reciprocate the butterfly valve operating rod 15 to open the butterfly valve wider and increase the flow of fuel to the carburetor 12. The resistance elements 140, and 148 are operative only when the operating lever 30 is thrown into the respective forward or reverse position as already described above.

The overall operation of the device is as follows. Inasmuch as the embodiment shown has been depicted as being applied to an automobile or the like, the description of the operation thereof will be limited to an automobile. However, it is to be understood that the invention is susceptible to application with any sort of device embodying a power plant, a driving and driven shaft and a hydraulic coupling between said shafts. The engine 11 is started in the usual manner and gasoline feed is controlled by the operating rod 14 for the butterfly valve. Thereafter, the operator shifts the lever 30 to either the forward or reverse position while any usual clutch such as 120 of FIG. 1 is engaged. As this time, the engine is idling and when the clutch 120 is engaged, the driving shaft 60, 60' and the driving blades 65 of the hydraulic coupling will be rotated at idling speed. In this situation there is insufficient pressure on the torquemeter of the electro-stress device 42 to supply any increased current other than the basic idle speed flow through the servomotor 18 necessary to maintain the same at a speed sufficient for an idling speed to the carburetor 12. Obviously, in this idling situation the driving blades 65 are not developing enough fluid flow to rotate the driven blades 75 and the output shaft 64. Consequently, the vehicle remains motionless even though the clutch 120 is engaged and the device is in gear.

To start the vehicle moving, the accelerator pedal is depressed. When the pedal is depressed contacts 115 are closed (See FIG. 2) which then connects line 116, line 37, the battery 26 with the relay line 117. Relay 118 is thus energized through the normally closed contacts 119 associated with the brake pedal 222. The other side of contacts 119 is grounded as indicated by 220. When relay 118 is energized the contacts 137 are closed to connect the power from battery 26 through the forward and reverse control 30, 31 as already described above. Assuming the operating lever has been thown to the forward drive position, as the accelerator pedal continues to be depressed, the adjustable rheostat 26 is varied to increase the flow of current to the servomotor 18 and simultaneously therewith, the arm 144 on the torquemeter is moved radially to decrease the resistance in the forward rheostate 140 to supply the maximum current to the servomotor 18. This in turn is operative to retract the butterfly valve actuating rod 15 to the fullest extent whereby to supply maximum fuel to the carburetor 12. Such increase in speed is effective to increase the speed of rotation of the driving shaft 60, 60' and driving blades 65 whereby to operatively couple such driving blades through increased fluid to the driven blades 75 and thus rotate the output shaft 64. Maximum movement of the forward speed is maintained until the inertia of the drive shaft 64 is overcome whereupon as such pressure is lessened, the torquemeter arm 144 is moved in the opposite direction to cut down the supply of current to the motor 18 and thereby reduce its speed and reduce the flow of fuel to the carburetor 12 to a point commensurate with the load on the drive shaft 64, without, however, necessarily reducing the speed of rotation of the latter.

Of course, it is not necessary to depress the accelerator pedal all the way. The degree to which the accelerator is depressed and the corresponding movement of the torquemeter arm 144 will be greatest at the point of starting when it is necessary to overcome the inertia of the drive shaft 64 and the load being driven thereby. Thus even though the accelerator is only partially it is quite likely that the movement of the torquemeter will be sufficiently great to provide maximum power to the engine 11 if the same is necessary. It should be clear from the foregoing, therefore, that the driver of the vehicle does not feed the fuel to the engine 11 manually and directly once the accelerator pedal 113 has been depressed. Thereafter, fuel feed is automatic in accordance with the load required and by proper adjustment of the component parts it is possible to get a much more economical flow of fuel than is possible with a direct manual control as it is well known that operators of automobiles frequently tend under heavy load conditions to feed more gas than the engine can take and thereby cause an inefficient operation of the engine. At any time that a braking condition occurs, the operator of the vehicle and user of this device, by stepping on the brake pedal 122, will in turn open the contacts 119 which will deenergize relay 118 and in turn open the contacts 137 to remove the battery power being supplied to the system. This effectively will let the servomotor and carburetor or fuel injection system return to the idle state.

Looking now at FIGS. 10, 11, and 12, the other embodiment of this invention will be described. FIG. 11 shows a transducer unit of the capacitance type which generally comprises a body 110 of tubular shape and of metal. This structure can be made extremely small of one-quarter inch size or less. Within the tubular member 110 is conductive tube 112, also preferably of metal, which is centrally positioned within the body member 110 so as to be coaxial therewith. Filling the space between the outer surface of the tube 112 and the inner wall of tubular body 110 is a solid insulating substance 114. This may be of cermaic, glass, or the like in a preferred form of construction, and is hermetically sealed by firing with the metal members 110 and 112.

As shown in FIG. 11, the upper end of tube 112 lies flush with the upper flat surface of the insulating substance 114. This flat surface is provided with a conductive metal film 116, preferably produced by painting the insulation surface with a suitable metallic compound and then firing same. This conductive film contacts the end of tube 112 and makes electrical contact therewith, but is out of electrical contact with the body member 110. This conductive film 116 forms the stationary or fixed electrode of the capacitance transducer unit. A central aperature in the metal film contact 116 is in alignment with the open end of tube 112.

From FIG. 11 it can also be seen that the metallic conductive electrode 116 is recessed below the rim level of body 110 by a small amount. A pressure responsive diaphragm 118 formed of metal of similar coefficient of expansion as the metal used for body member 110, is welded around the rim of the body member so as to leave an air gap A between the diaphragm and the conductive film 116. The air gap A allows for flexing of diaphragm 118, which functions as the movable electrode of the capacitance transducer unit.

It is very important that complete electrical shielding of the transducer be provided for excluding interference which might originate outside of the assembly as well as to prevent signal variations due to capacity changes resulting from relative movement between various portions of the cell body and between the electrical connections thereto. Therefore, a tubular shield 122 extends downwardly from the insulating member 114 and is arranged to be coaxial both with the inner tube 112 and the body 110. Another insulator 124 is between the shield 122 and the tube 112 preferably of plastic material having high dielectric properties. The shield 122 is arranged to contact one portion of an adaptor, shown in dotted outline, and identified by the reference numeral 125, which provides electric connections from a lead-in cable to the capacitance transducer and also facilitates the conveyance of a reference fluid under predetermined pressure through the tube 112 to fill the space between the stationary and movable capacitor electrodes 116 and 118. The details of this adaptor unit 125 are shown in FIG. 12.

Figure 11:
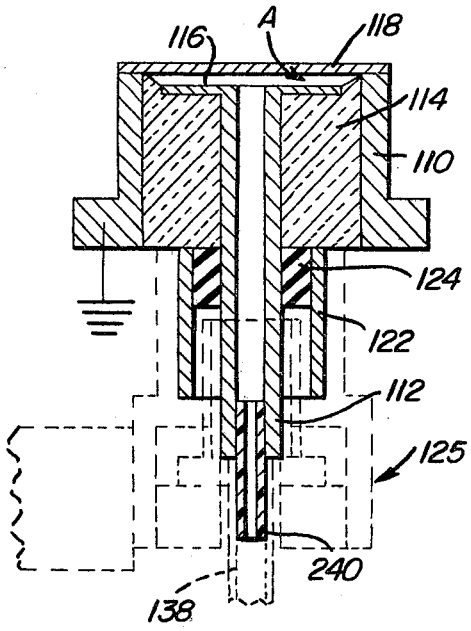
FIG. 11 is a cross-sectional view of a capacitance transducer per se as used in the second embodiment of the invention.
Figure 12:
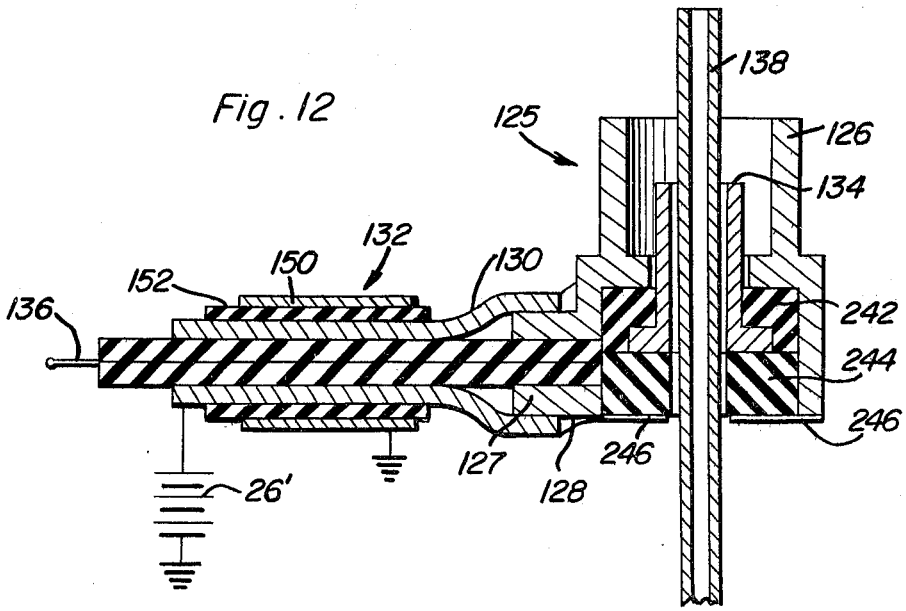
FIG. 12 is a cross-sectional view of an adaptor unit used with the capacitance transducer of FIG. 11.

FIG. 12 shows the adaptor unit 125 which consists of a generally tubular outer body member 126, of electrically conductive material, and provided with a radial extension 127 which permits connection thereto such as by soldering 128 of the inner shield 130 of a triaxial cable 132. Nestled within the body member 126 of the connector, but out of electrical engagement therewith, is a generally tubular insert 134 to which is affixed by soldering or otherwise, the inner conductor 136 of the triaxial cable 132. A flexible tube 138 which may be of plastic, extends through the insert 134 and leads to a source of reference fluid pressure. The tube 112 of FIG. 11 is provided with an extension 240 of reduced diameter over which the flexible end of tube 138 of FIG. 12 is slipped when the adaptor unit is brough into operative relation with the transducer. The tube 138 is loosely carried within the insert 134 so as to have freedom of longitudinal movement with respect thereto. This connection is shown by dotted lines in FIG. 11.

The insert 134 is positioned relative to the adaptor body 126 by an insulator 242 and by a further insulating substance 244 which may be typical liquid potting compound. A coating 246 of conductive material is provided on the outer surface of the insulating substance 244 for forming an electrical contact with the adaptor body 126 and with the inner shield 130 of the cable 132. The inner shield 130 of the triaxial cable 132 is maintained at a constant DC potential by means of the battery 26', which in the application of this invention would be the vehicle battery. The outer shield 150 of the cable is grounded as shown, with the two cable shields 130 and 150 being separated by a layer 152 of suitable insulative material.

When the adaptor of FIG. 12 is first connected to the capacitance transducer of FIG. 11, the flexible tube 138 of the adaptor slips over the extending portion 240 of the transducer stem 112. This establishes a conduit for conveying fluid to the inner surface of the diagragm 118 from a suitable source of pressure. In some applications such as the one disclosed herein, thefluid may be permanently sealed within the capacitance transducer and the above-described connection eliminated. The insert 134 of the adaptor also makes a sliding fit with the tube 112, the former acting as a sleeve for the latter. This electrically connects the stationary electrode 116 of the capacitor to the central conductor 136 of the triaxial cable 132. In addition, the inner shield 130 of the cable (which is soldered to the adaptor shell 126) makes electrical contact with the tubular shield 122 of the pressure cell through a sliding fit between the members 122 and 126. This sliding fit is terminated when the top of the adaptor shell 126 (as seen in FIG. 11) makes physical contact with the lower surface of the insulating substance 114 which fills the interior of the transducer unit, the two units then having the relative positions shown in FIG. 11. However, the member 126 does not enter into electrical engagement with the trandsucer body member 110. The result of the above association is to place the shield 122 at the DC potential of the battery 26'.

To complete the electrical circuit for the capacitance transducer unit, the shell 110 of the transducer is grounded to correspondingly ground the diaphragm 118. The outer shield 150 of the triaxial cable 132 is also grounded as shown. The output of the transducer is quite small and thus must be amplified by a suitable conventional type amplifier before controlling the servomotor 18 of the vehicle fuel feed control system. Such an amplifier preferably is of the solid-state transistor type, and is mounted between the two capacitance transducer units 242 in the driven vanes 75' (FIG. 10) and the connecting leads 40, 44, and 48 of the electrical circuit.

Figure 10:
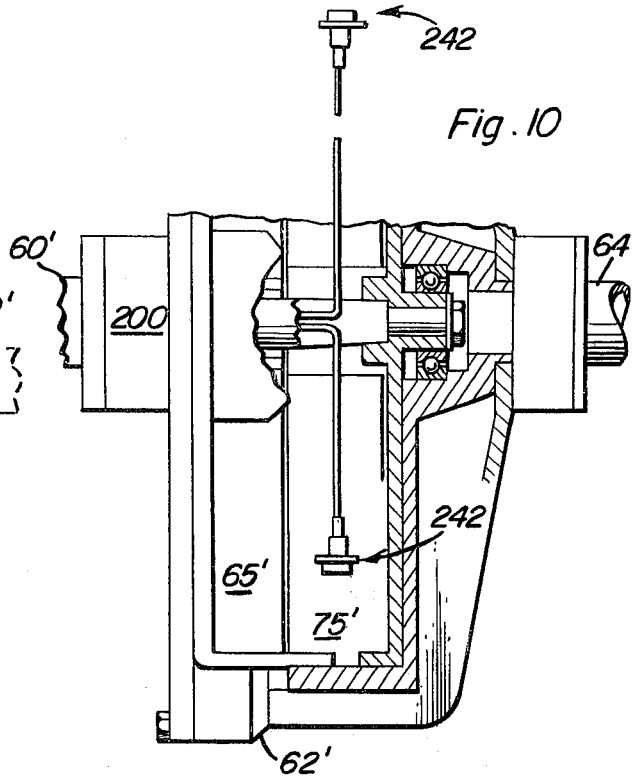
FIG. 10 is a vertical elevation, partly in cross-section, of a hydraulic coupling with capacitance transducer units therewith in a second embodiment of the invention.
Figure 6:
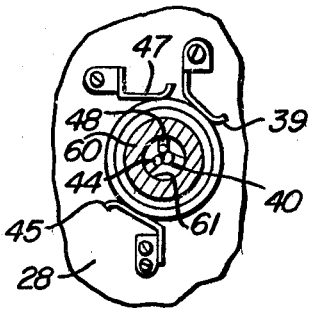
FIG. 6 is an end view, partly in cross-section, taken generally along line 6—6 of FIG. 2.
Figure 7:
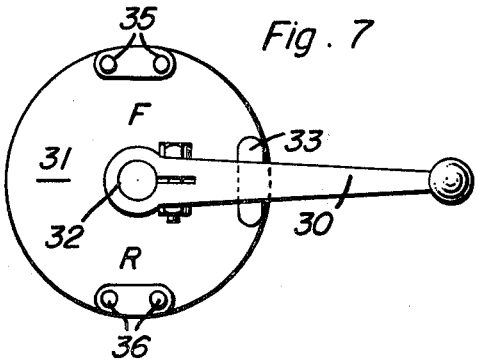
FIG. 7 is a plan view of the forward and reverse controller of FIGS. 1 and 2 on an enlarged scale.
Figure 8:
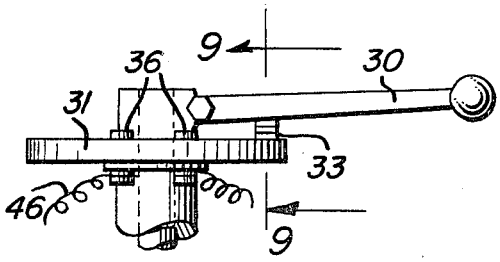
FIG. 8 is an elevational view of the controller of FIG. 8.
Figure 9:
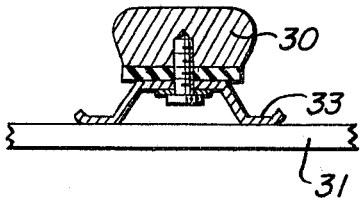
FIG. 9 is a cross-section taken generally along line 9—9 of FIG. 8.

As seen in FIG. 10 of the drawings, at least two of these capacitance transducer units are positioned on respective driven blades 75' of the hydraulic coupling unit. This coupling unit is housed in a housing 62' similar to that described for the first embodiment. One of the transducer units is used as a forward drive responsive unit and appropriately connected by means of amplifier stages in housing unit 200 to the electrical leads 40' and 44' and corresponding slip rings and slip ring connectors as described for the first embodiment. Similarly the second transducer unit is connected as a reverse pressure responsive device and connected to the electrical leads 44' and 48' through appropriate amplifier units. The amplifier units in housing 200 may be of solid state type which requires very little power for energization thereof as well as being very small and light in weight. If necessary, slip ring structure similar to that already disclosed may be used with these amplifiers, but normally the units may be directly attached to the drive shaft 60 without harm thereto. For example, they may be appropriately mounted within the hollow tubular shaft 60' along with the wires 40, 44, and 48 as best seen in FIG. 6 of the drawings. Thus mounted, no additional slip ring structure is needed.

It thus can be readily visualized that the capacitor transducer units of this second embodiment will function in much the same manner as the electrical resistance units 140 and 148 of the torquemeter of the first embodiment and the overall manner of operation of this embodiment is similar to the first embodiment.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with an internal combustion engine having a variable fuel supply means and connected to a load through a power drive train, a load responsive control comprising:

a power supply;

a variable speed electric motor means electrically connected in circuit with said power supply for rotation at an angular velocity dependant upon the level of the electrical input applied thereto;

mechanical linkage means connected between said electric motor and said variable fuel supply means for adjusting the amount of fuel supply to said internal combustion engine dependent upon the speed of rotation of said electric motor;

primary adjustment means connected in series circuit with said electric motor for controlling the level of electrical input supplied to said electric motor, said primary adjustment means being attached to an accelerator pedal for varying said electrical input in response to the position of said accelerator pedal;

secondary adjustment means connected in electrical circuit with said electric motor and said primary adjustment means and mechanically connected to said drive train for adjusting the input to said electric motor in response to the torque transmitted to said load through the drive train.

2. The combination of claim 1 wherein the power drive train includes a hydraulic coupling unit having at least two driven blades and wherein the secondary adjusting means comprises a first capacitive transducer disposed on one of the driven blades and a second capacitive trandsducer disposed on the other of the driven blades; and switch means for selectively connecting either first capacitive transducer or said second capacitive transducer in said series circuit.

3. The combination of claim 1 wherein said power drive train includes a drive shaft having a first drive shaft portion and a second drive shaft portion, the shaft portions being aligned and having adjacent ends spaced apart;

wherein said secondary adjustment means comprises first and second resistor means attached to said first portion and an electrical contact means attached to said second portion and engaged for movement along either said first or second resistor means in response to twisting of said shaft; and switch means for selectively engaging either of said first or said second resistor means in said electrical circuit.

4. The combination of claim 1 and further including start switch means attached to said accelerator pedal for selectively applying and removing said electrical input to said electrical motor in response to the position of said accelerator pedal.

5. The combination of claim 4 and further including a brake pedal; and stop switch means attached to said brake pedal for removing the electrical input to said electric in response to actuation of said brake pedal.

6. The combination of claim 4 wherein said start switch means comprises a pair of normally open contacts which close upon depression of said accelerator pedal and actuate a relay, said relay being effective to close a pair of contacts in series with said power supply.

7. The combination of claim 5 wherein said stop switch means comprises a pair of normally closed contacts connected in circuit with a relay, said normally closed contacts being opened by depression of said brake pedal for causing said relay to open contacts in series with said power supply.

8. The combination of claim 1 wherein said variable fuel supply means is responsive to movements of said accelerator pedal only through variations in speed of said electric motor.

* * * * *